US011549461B2

(12) United States Patent
Yamamoto et al.

(10) Patent No.: US 11,549,461 B2
(45) Date of Patent: Jan. 10, 2023

(54) HIGH STRENGTH ALUMINUM ALLOY, INTERNAL COMBUSTION ENGINE PISTON COMPRISING SAID ALLOY, AND METHOD FOR MANUFACTURING INTERNAL COMBUSTION ENGINE PISTON

(71) Applicants: NIPPON LIGHT METAL COMPANY, LTD., Tokyo (JP); ART METAL MFG. CO., LTD., Ueda (JP)

(72) Inventors: Izumi Yamamoto, Shizuoka (JP); Kazuhiro Oda, Shizuoka (JP); Hiroshi Horikawa, Tokyo (JP); Katsumi Fukaya, Tokyo (JP); Takashi Seki, Ueda (JP); Tadashi Watanabe, Ueda (JP)

(73) Assignees: NIPPON LIGHT METAL COMPANY, LTD., Tokyo (JP); ART METAL MFG. CO., LTD., Ueda (JP)

( * ) Notice: Subject to any disclaimer, the term of this patent is extended or adjusted under 35 U.S.C. 154(b) by 0 days.

(21) Appl. No.: 16/327,279

(22) PCT Filed: Aug. 29, 2016

(86) PCT No.: PCT/JP2016/075214

§ 371 (c)(1),
(2) Date: Feb. 21, 2019

(87) PCT Pub. No.: WO2018/042494

PCT Pub. Date: Mar. 8, 2018

(65) Prior Publication Data

US 2019/0186410 A1 Jun. 20, 2019

(51) Int. Cl.

| | |
|---|---|
| ***C22F 1/04*** | (2006.01) |
| ***F02F 3/00*** | (2006.01) |
| ***C22C 21/02*** | (2006.01) |
| ***C22F 1/043*** | (2006.01) |

(52) U.S. Cl.
CPC ..... *F02F 3/0084* (2013.01); *C22C 21/02* (2013.01); *C22F 1/043* (2013.01)

(58) Field of Classification Search
CPC ..... C22C 21/02; C22F 1/043; F02F 3/0084
See application file for complete search history.

(56) References Cited

U.S. PATENT DOCUMENTS

| | | | | | |
|---|---|---|---|---|---|
| 4,975,243 | A * | 12/1990 | Scott | C22C 21/02 | 148/438 |
| 5,055,255 | A * | 10/1991 | Scott | C22C 21/02 | 420/534 |
| 5,162,065 | A * | 11/1992 | Scott | C22C 21/02 | 148/438 |
| 2010/0006192 | A1* | 1/2010 | Okamoto | B22D 21/007 | 148/691 |
| 2015/0315688 | A1* | 11/2015 | Doty | C22C 21/14 | 420/532 |
| 2019/0293120 | A1* | 9/2019 | Schmitt | F16C 33/121 | |

FOREIGN PATENT DOCUMENTS

| | | | |
|---|---|---|---|
| JP | 2004-076110 | A | 3/2004 |
| JP | 2004-256873 | A | 9/2004 |
| JP | 2006-241531 | A | 9/2006 |
| JP | 2014-152375 | A | 8/2014 |
| JP | 2014152375 | A * | 8/2014 |
| WO | 2008/016169 | A1 | 2/2008 |

OTHER PUBLICATIONS

JP 2014152375A English Translation (publication: Aug. 2014).*
MatWeb Overview of Materilas for 4000 Series.*
Piston Materials Chapter 7.*
Oct. 4, 2016 International Search Report issued in International Patent Application No. PCT/JP2016/075214.
Feb. 4, 2020 Search Report issued in European Patent Application No. 16915055.4.

* cited by examiner

*Primary Examiner* — George C Jin
*Assistant Examiner* — Teuta B Holbrook
(74) *Attorney, Agent, or Firm* — Oliff PLC

(57) ABSTRACT

An aluminum alloy having excellent high temperature strength and thermal conductivity; and an internal combustion engine piston including the alloy. The aluminum alloy includes 11.0-13.0% Si, ≤0.3% Fe, 0.3-2.0% Mg, 2.0-5.0% Cu, 3.0-4.0% Ni, 0.2-1.0% Mn, 0.05-0.4% Cr, and 0.05-0.4% V, with the remainder including aluminum and unavoidable impurities.

5 Claims, No Drawings

HIGH STRENGTH ALUMINUM ALLOY, INTERNAL COMBUSTION ENGINE PISTON COMPRISING SAID ALLOY, AND METHOD FOR MANUFACTURING INTERNAL COMBUSTION ENGINE PISTON

TECHNICAL FIELD

The present invention pertains to a high strength aluminum alloy, an internal combustion engine piston comprising said alloy, and a method for manufacturing an internal combustion engine piston.

BACKGROUND ART

An internal combustion engine piston of an engine of an automobile or the like is repeatedly exposed to high temperatures during use. Due thereto, strength at high temperatures and fatigue strength are demanded. Here, in order to form a crystallized product that does not readily soften even at high temperatures in an Al parent phase to obtain mechanical strength at high temperatures, elements such as Si, Mg, Fe, Cu, Ni, and Mn are added to an alloy for the piston and softening at high temperatures is suppressed. Moreover, by refining the Al parent phase structure, fatigue strength is improved (Patent Document 1). Further, by precipitating an Al—Cu—Mg-based compound, the thermal conductivity of the piston is improved to ensure that the piston itself does not reach a high temperature even when exposed to high temperatures (Patent Document 2).

PRIOR ART DOCUMENTS

Patent Documents

Patent Document 1: Japanese Published Patent Publication No. 2004-076110

Patent Document 2: Japanese Published Patent Publication No. 2014-152375

SUMMARY OF INVENTION

In recent years, there has been even higher demand for an increase in the output of automobile engines and combustion temperatures of engines have also tended to rise. Due thereto, the usage environment of the piston has also become more harsh. Here, the objective of the present invention is to provide an aluminum alloy for an internal combustion engine piston that can withstand repeated use at high temperatures, and specifically, to provide an aluminum alloy having excellent heat resistance and thermal conductivity.

According to the present invention, provided is an aluminum alloy comprising 11.0-13.0% Si, ≤0.3% Fe, 0.3-2.0% Mg, 2.0-5.0% Cu, 3.0-4.0% Ni, 0.2-1.0% Mn, 0.05-0.4% Cr, and 0.05-0.4% V, with the remainder comprising aluminum and unavoidable impurities.

According to one embodiment of the present invention, provided is the abovementioned aluminum alloy further containing 0.05-0.4% Ti, 0.05-0.4% Zr, and 0.0005-0.015% P.

According to one embodiment of the present invention, provided is an aluminum alloy for an internal combustion engine piston, said aluminum alloy having the abovementioned composition.

According to one embodiment of the present invention, provided is an internal combustion engine piston made of an aluminum alloy, said piston comprising an aluminum alloy having the abovementioned composition and a thermal conductivity of at least 135 W/(k·m).

Further, according to the present invention, provided is a method for manufacturing an internal combustion engine piston, wherein an aluminum alloy having the abovementioned composition is cast and an aging treatment is performed.

Further, according to the present invention, provided is a method for manufacturing an internal combustion engine piston, said piston having an aluminum alloy with a thermal conductivity of at least 135 W/(k·m).

According to the present invention, it is possible to provide: an aluminum alloy having excellent high temperature strength and thermal conductivity; and an internal combustion engine piston comprising said alloy.

DESCRIPTION OF EMBODIMENTS

Embodiments of the present invention are described below. However, the present invention is not to be interpreted as being limited to these embodiments. It should be noted that in the following descriptions, "A-B" means "at least A and no more than B".

The aluminum alloy according to the present embodiment comprises 11.0-13.0% Si, ≤0.3% Fe, 0.3-2.0% Mg, 2.0-5.0% Cu, 3.0-4.0% Ni, 0.2-1.0% Mn, 0.05-0.4% Cr, and 0.05-0.4% V, with the remainder comprising aluminum and unavoidable impurities. This aluminum alloy has excellent high temperature strength and thermal conductivity.

Si (Silicon)

Si forms eutectic Si and compounds (Mg—Si-based, Al—Si—(Mn, Cr) Fe-based, etc.) with other added elements and, in particular, improves mechanical strength at high temperatures and fatigue strength. This action is remarkable when Si content is at least 11.0%. By Si content being no more than 13%, coarsening of primary crystal Si, which is an origin of breakage, is suppressed and it is possible to suppress a decrease in mechanical strength at room temperature.

Fe (Iron)

Fe is an unavoidable impurity incorporated from scrap, etc. which is a raw material, but forms compounds (Al—Si—(Mn, Cr) Fe-based, Al—Fe—Mn—Ni—Cr-based, etc.) with other added elements and improves strength at room temperature and high temperatures (in particular, high temperatures). Further, Fe also has an action for preventing burn-in to a metal mold.

By Fe content being no more than 0.3%, coarsening of compounds, which is an origin of breakage, is suppressed and it is possible to suppress fatigue strength from decreasing due to mechanical properties decreasing at room temperature. Further, when Fe content is high, thermal conductivity decreases and therefore also from this perspective, limiting Fe content to no more than 0.3% is preferred. More preferably, limiting Fe content to no more than 0.2% is preferred.

In the aluminum alloy according to the present embodiment, Fe, which was conventionally added with an objective of improving heat resistance strength, is one factor for a decrease in thermal conductivity and therefore the amount thereof is limited in order to increase thermal conductivity. In the aluminum alloy according to the present embodiment, in order to increase heat resistance, the addition amounts of Cu, Ni, and Mn are increased, the amount of formations of compounds contributing to heat resistance is increased, and solid solutions of Ti, V, and Zr are formed in the Al phase, thereby increasing heat resistance.

Mg (Magnesium)

Mg forms compounds (Al—Cu—Mg-based, Mg—Si-based, etc.) with other added elements and improves strength at room temperature and high temperatures (in particular, high temperatures). This effect is remarkable when Mg is added so that Mg content is at least 0.3%. By Mg content being no more than 2.0%, it is possible to suppress a decrease in thermal conductivity.

Cu (Copper)

Cu forms compounds (Al—Cu-based, Al—Cu—Mg-based, Al—Cu—Ni-based, etc.) with other added elements and improves strength at room temperature and high temperatures (in particular, high temperatures). This effect is remarkable when Cu content is at least 2.0%, and this effect is even more remarkable when Cu content is at least 3.0%. When Cu content is no more than 5.0%, coarsening of compounds, which is an origin of breakage, is suppressed and it is possible to suppress a decrease in mechanical properties (tensile strength, elongation). Due thereto, it is possible to suppress a decrease in fatigue strength and a decrease in corrosion resistance.

It should be noted that when the amount of solid solutions of Cu in the Al parent phase is large, thermal conductivity decreases and therefore it is preferable that Cu content is no more than 4.0%.

Ni (Nickel)

Ni forms compounds (Al—Cu—Ni-based, Al—Fe—Mn—Ni—Cr-based, etc.) with other added elements and improves strength at room temperature and high temperatures (in particular, high temperatures). This effect is remarkable when Ni is added so that Ni content is at least 3.0%. If Ni content is no more than 4.0%, coarsening of compounds, which is an origin of breakage, is suppressed and it is possible to suppress a decrease in mechanical properties at room temperature and a decrease in thermal conductivity.

Mn (Manganese)

By forming a solid solution in the Al parent phase, Mn improves mechanical properties at room temperature and high temperatures. This effect is remarkable when Mn is added so that Mn content is at least 0.2%, and the effect is more remarkable when at least 0.4%. Moreover, Mn has an action of granulating Al—Si—Fe-based compounds, which readily coarsen and become acicular, as Al—Si—Mn, —Fe-based and Al—Si—(Mn, Cr)—Fe-based compounds. When an acicular crystallized product structure becomes granular, the crystallized product less readily becomes an origin of breakage, mechanical properties improve, and fatigue strength also improves. By Mn content being no more than 1.0%, coarsening of compounds, which is an origin of breakage, can be suppressed and it is possible to suppress fatigue strength from decreasing due to mechanical properties decreasing. It should be noted that when Mn content in the Al parent phase is large, thermal conductivity readily decreases and therefore it is preferable that the Mn content is no more than 0.5%.

Cr (Chrome)

Along with Mn, Cr has an action of granulating Al—Si—Fe-based compounds, which readily become acicular, as Al—Si—Mn—Fe-based and Al—Si—(Mn, Cr)—Fe-based compounds. When an acicular crystallized product structure becomes granular, becoming an origin of breakage less readily occurs and mechanical properties improve. Fatigue strength also improves. In addition to having an action of crystallizing as an Al—Si—(Mn, Cr)—Fe-based compound and improving strength at room temperature and high temperatures, Cr also has an action of reducing the amount of Mn and Fe solid solutions in the Al parent phase and improving thermal conductivity. This effect is remarkable when Cr is added so that Cr content is at least 0.2%, and by Cr content being no more than 0.4%, coarsening of compounds, which is an origin of breakage, is suppressed and it is possible to suppress a decrease in mechanical properties at room temperature and a decrease in thermal conductivity.

Further, according to another embodiment of the present invention, the aluminum alloy of the abovementioned embodiment may further contain 0.05-0.4% Ti, 0.05-0.4% V, 0.05-0.4% Zr, and 0.0005-0.015% P.

Ti (Titanium)

In addition to having an action of refining the Al parent phase during casting and improving elongation and fatigue strength, Ti also has an action of forming solid solutions in the Al parent phase and raising high temperature strength. This action is remarkable when Ti content is at least 0.05%. When Ti content is no more than 0.4%, it is possible to suppress coarsening of Ti compounds, which is an origin of breakage, and a decrease in mechanical properties can be suppressed. It should be noted that when the amount of Ti solid solutions in the Al parent phase is large, thermal conductivity decreases and therefore it is more preferable that Ti content is less than 0.15%.

V (Vanadium)

V has an action of forming solid solutions in the Al parent phase and raising high temperature strength. This action is remarkable when V content is at least 0.05%. By V content being no more than 0.4%, the amount of solid solutions in the Al parent phase becoming large is suppressed and a decrease in thermal conductivity is suppressed. From the perspective that toughness decreases due to the suppression of creation of coarse compounds, it is more preferable that V content is less than 0.15%.

Zr (Zirconium)

In addition to having an action of refining the Al parent phase during casting, Zr also has an action of forming solid solutions in the Al parent phase and raising high temperature strength. This action is remarkable when Zr content is at least 0.05%, and by Zr content being no more than 0.4%, it is possible to suppress coarse Al—Zr-based compounds from crystallizing during casting and becoming a casting defect, which is an origin of breakage, and suppress mechanical properties from decreasing. It should be noted that when the amount of Zr solid solutions in the Al parent phase is large, thermal conductivity decreases and therefore it is more preferable that Zr content is less than 0.2%.

P (Phosphorous)

P has an action of refining primary crystal Si. This action is remarkable when P content is at least 0.0005%. Even if P is added so that P content exceeds 0.015%, an improvement in this action is not seen.

Further, according to another embodiment of the present invention, provided is a method for manufacturing an internal combustion engine piston wherein an aluminum alloy according to the abovementioned embodiment is cast and an aging treatment is performed.

The method for casting the alloy of the present invention is not limited to a specific method for casting, but the faster the cooling rate is during casting, the more refined the Al parent phase and the crystallized product become, and the more readily elongation and fatigue strength are improved.

However, when the cooling rate during casting is too fast, there is a concern that the amount of solid solutions of the added elements will become large and thermal conductivity will decrease, and therefore, a casting speed in the range of 5-27° C./s is preferable.

During casting, a portion of Si, Fe, Mg, Cu, Mn, Cr, V, and Zr forms solid solutions in the Al parent phase. When formed as solid solutions in the Al parent phase, these elements exhibit an action for inhibiting thermal conductivity. By performing an aging treatment, these elements are precipitated as precipitations, thereby improving thermal conductivity and also improving mechanical properties. It is preferable that the aging treatment is carried out as overaging in order to sufficiently reduce the amount of solid solutions. It should be noted that it is more preferable for a solutionizing treatment to be carried out prior to the aging treatment after casting.

The aluminum alloy described in the abovementioned embodiment pertains to a high strength aluminum cast alloy having excellent high temperature strength and thermal conductivity, and this alloy is particularly suitable for an internal combustion engine piston which is exposed to high temperatures. An internal combustion engine piston means, specifically, a member (such as a head of a piston or the like) of a diesel piston or a gasoline piston, etc. of an automobile engine.

EXAMPLES

Examples relating to the present invention are shown below. The details of the present invention are not to be interpreted as being limited to these examples.

Aluminum alloys having the compositions shown in Table 1 were cast by gravity die casting (casting speed 10° C./s) in a cylindrical shape having (p of 150 mm and a height of 200 mm and an aging treatment was performed with a holding temperature of 220° C. and a holding time of 240 min. The unit of the compositions of Table 1 is weight %.

TABLE 1

| | Si | Mg | Cu | Ni | Mn | Cr | Ti | Zr | V | Fe | P |
|---|---|---|---|---|---|---|---|---|---|---|---|
| Example 1 | 12.5 | 0.9 | 3.8 | 3.4 | 0.45 | 0.1 | 0.1 | 0.1 | 0.1 | 0.2 | 0.01 |
| Example 2 | 11.3 | 1.8 | 4.7 | 3.2 | 0.8 | 0.05 | 0.3 | 0.06 | 0.06 | 0.28 | — |
| Example 3 | 12.8 | 0.4 | 2.3 | 3.8 | 0.3 | 0.3 | 0.1 | 0.1 | 0.1 | 0.2 | 0.01 |
| Comparative Example 1 | 12 | 1 | 3.4 | 3.2 | 0.4 | 0.1 | 0.1 | 0.1 | 0.1 | 0.4 | 0.01 |
| Comparative Example 2 | 12 | 0.8 | 3.5 | 2.5 | 0.4 | 0.1 | 0.1 | 0.1 | 0.1 | 0.2 | 0.01 |
| Comparative Example 3 | 12 | 0.9 | 4 | 4.5 | 0.4 | 0.1 | 0.1 | 0.1 | 0.1 | 0.2 | — |
| Comparative Example 4 | 12.2 | 0.8 | 3 | 3.2 | 0.4 | 0.02 | 0.1 | 0.1 | 0.1 | 0.2 | 0.01 |
| Comparative Example 5 | 11.5 | 0.1 | 3 | 3.5 | 0.4 | 0.1 | 0.1 | 0.1 | 0.1 | 0.2 | — |
| Comparative Example 6 | 12.5 | 2.2 | 4 | 3.5 | 0.4 | 0.1 | 0.1 | 0.1 | 0.1 | 0.2 | — |
| Comparative Example 7 | 10.5 | 1 | 2.9 | 3.3 | 0.4 | 0.1 | 0.1 | 0.1 | 0.1 | 0.2 | — |
| Comparative Example 8 | 13.5 | 1 | 4.2 | 3.7 | 0.4 | 0.1 | 0.1 | 0.1 | 0.1 | 0.2 | 0.01 |
| Comparative Example 9 | 11.5 | 1 | 1.5 | 3.4 | 0.4 | 0.1 | 0.1 | 0.1 | 0.1 | 0.2 | 0.01 |
| Comparative Example 10 | 12.3 | 1 | 5.3 | 3.3 | 0.4 | 0.1 | 0.1 | 0.1 | 0.1 | 0.2 | 0.01 |
| Comparative Example 11 | 12 | 1 | 3 | 3.5 | 0.1 | 0.1 | 0.1 | 0.1 | 0.1 | 0.2 | 0.01 |
| Comparative Example 12 | 12 | 1 | 3 | 3.5 | 1.2 | 0.1 | 0.1 | 0.1 | 0.1 | 0.2 | 0.01 |
| Comparative Example 13 | 12.2 | 0.8 | 3 | 3.2 | 0.4 | 0.7 | 0.1 | 0.1 | 0.1 | 0.2 | 0.01 |

The tensile strength at room temperature and at 350° C. and the fatigue strength at 350° C. and the thermal conductivity of the obtained cast product were measured. Table 2 shows the results of an assessment of the properties of each experimental example.

TABLE 2

| | Tensile Strength MPa | | Rotary Fatigue Strength MPa | Thermal Conductivity W/(k · m) |
|---|---|---|---|---|
| | Room Temperature | 350° C. | 350° C. $10^8$ rotations | Room Temperature |
| Example 1 | 275 | 68 | 45 | 142 |
| Example 2 | 267 | 70 | 47 | 139 |
| Example 3 | 281 | 66 | 43 | 144 |
| Comparative Example 1 | 259 | 69 | 46 | 130 |
| Comparative Example 2 | 272 | 59 | 37 | 143 |
| Comparative Example 3 | 250 | 72 | 44 | 140 |
| Comparative Example 4 | 274 | 67 | 45 | 133 |
| Comparative Example 5 | 270 | 58 | 40 | 143 |
| Comparative Example 6 | 283 | 67 | 42 | 130 |
| Comparative Example 7 | 271 | 60 | 39 | 141 |
| Comparative Example 8 | 255 | 66 | 43 | 141 |
| Comparative Example 9 | 272 | 53 | 36 | 147 |
| Comparative Example 10 | 240 | 70 | 35 | 130 |
| Comparative Example 11 | 260 | 60 | 37 | 146 |

TABLE 2-continued

| | Tensile Strength MPa | | Rotary Fatigue Strength MPa | Thermal Conductivity W/(k · m) |
|---|---|---|---|---|
| | Room Temperature | 350° C. | 350° C. $10^8$ rotations | Room Temperature |
| Comparative Example 12 | 244 | 71 | 34 | 124 |
| Comparative Example 13 | 265 | 67 | 38 | 132 |
| Acceptance Criteria | 264 | 66 | 43 | 135 |

According to the results of Table 2, in Comparative Example 1, it is understood that there is a large amount of Fe and therefore tensile strength and thermal conductivity are low. Further, in Comparative Example 2, there is small amount of Ni and therefore tensile strength and fatigue strength at 350° C. are low. In Comparative Example 3, there is a large amount of Ni and therefore tensile strength is low.

In Comparative Example 4, there is a small amount of Cr and therefore thermal conductivity is low. In Comparative Example 5, there is a small amount of Mg and therefore tensile strength and fatigue strength at 350° C. are low. In Comparative Example 6, there is a large amount of Mg and therefore thermal conductivity is low. In Comparative Example 7, there is a small amount of Si and therefore tensile strength and fatigue strength at 350° C. are low.

In Comparative Example 8, there is a large amount of Si and therefore tensile strength is low. In Comparative Example 9, there is a small amount of Cu and therefore tensile strength and fatigue strength at 350° C. are low. In Comparative Example 10, there is a large amount of Cu and therefore tensile strength and thermal conductivity are low. In Comparative Example 11, there is a small amount of Mn and therefore tensile strength and fatigue strength are low. In Comparative Example 12, there is a large amount of Mn and therefore tensile strength, fatigue strength, and thermal conductivity are low. In Comparative Example 13, there is a large amount of Cr and therefore thermal conductivity is low.

Although acceptance criteria are defined as in Table 2, it is understood that these acceptance criteria are satisfied by the alloys of Examples 1 to 3 according to the present invention, but these criteria are not satisfied by the alloys of the Comparative Examples.

The invention claimed is:

1. An aluminum alloy consisting of
11.0-13.0% Si,
≤0.3% Fe,
0.3-2.0% Mg,
2.0-5.0% Cu,
3.2-4.0% Ni,
0.2-1.0% Mn,
0.05-0.4% Cr,
0.05-0.4% V,
0.05-0.4% Ti,
0.05-0.4% Zr,
0.0005-0.015% P, and
the remainder consisting of aluminum and unavoidable impurities, wherein a crystallized product structure of the alloy is granular.

2. An aluminum alloy for an internal combustion engine piston, said aluminum alloy having the composition according to claim 1.

3. An internal combustion engine piston made of an aluminum alloy, said piston comprising an aluminum alloy having the composition according to claim 1 and a thermal conductivity of at least 135 W/(k·m).

4. A method for manufacturing an internal combustion engine piston, comprising casting an aluminum alloy having the composition according to claim 1 and performing an aging treatment.

5. The method for manufacturing an internal combustion engine piston according to claim 4, wherein the aluminum alloy has a thermal conductivity of at least 135 W/(k·m).

* * * * *